United States Patent [19]

Kurimoto et al.

[11] Patent Number: 4,659,631

[45] Date of Patent: Apr. 21, 1987

[54] CORROSION RESISTANT DUPLEX PLATED SHEET STEEL

[75] Inventors: Tatsuo Kurimoto, Wakayama; Yoshihiko Hoboh, Osaka; Hiroshi Ohishi, Wakayama; Ryoichi Noumi, Minoo; Shigeru Wakano, Kobe, all of Japan

[73] Assignee: Sumitomo Metal Industries, Ltd., Osaka, Japan

[21] Appl. No.: 734,134

[22] Filed: May 15, 1985

[30] Foreign Application Priority Data

May 17, 1984 [JP] Japan ..... 59-97580
Feb. 21, 1985 [JP] Japan ..... 60-33486

[51] Int. Cl.[4] ..... B32B 15/01
[52] U.S. Cl. ..... 428/624; 428/659
[58] Field of Search ..... 428/659, 621, 624; 427/433; 204/44.2, 55 R

[56] References Cited

U.S. PATENT DOCUMENTS 4,064,320 12/1977 Adaniya et al. ..... 428/659
4,202,921 5/1980 Enghag ..... 428/659
4,216,272 8/1980 Clauss ..... 428/659
4,252,866 2/1981 Matsudo et al. ..... 428/659
4,407,900 10/1983 Kirihara et al. ..... 428/659
4,490,438 12/1984 Tsuda et al. ..... 428/659
4,519,878 5/1985 Hara et al. ..... 428/659

FOREIGN PATENT DOCUMENTS 43477 3/1985 Japan ..... 428/659

*Primary Examiner*—L. Dewayne Rutledge
*Assistant Examiner*—Robert L. McDowell
*Attorney, Agent, or Firm*—Burns, Doane, Swecker & Mathis

[57] ABSTRACT

A corrosion resistant duplex plated sheet steel is disclosed, which comprises a sheet steel having on at least one surface thereof a lower layer of Zn base alloy plating and an upper layer thereon selected from a zinc plating having a coating weight of 0.1–5 g/m$^2$ and a zinc alloy or zinc composite plating having a coating weight of 0.1–10 g/m$^2$. The ratio of the coating weight of the lower layer to that of the upper layer is at least 1:1 and in the case of upper layer of zinc alloy or zinc composite plating, it comprises, on a weight basis as metal, at least 80% Zn, and one or more additives as Zn corrosion inhibitors selected from Ni, Co, Mn, Sn, Ti, Al, Mg and Si. The duplex plated sheet steel is suitable for coating thereon with an electrophoretic coating composition and exhibits excellent cratering resistance in cathodic electrophoretic coating and excellent cosmetic resistance after painting.

22 Claims, No Drawings

CORROSION RESISTANT DUPLEX PLATED SHEET STEEL

BACKGROUND OF THE INVENTION

The present invention relates to a pre-coated sheet steel capable of providing an excellent cosmetic corrosion resistance and crater-free paint appearance. More particularly, it relates to a duplex plated sheet steel having a lower layer of Zn base alloy and an upper layer of Zn plating or Zn base alloy or composite plating. The pre-coated sheet steel will be particularly suitable for automobile exterior panels.

As the amount of road deicing salt used in North America and Europe has been increasing, various zinc alloy plated sheet steels have been developed and some of them are practically employed in order to protect automobile bodies more effectively against inside-out corrosion.

Furthermore, the demand becomes greater for a good protection against cosmetic corrosion of automobile exterior panels in recent years. The cosmetic corrosion initiates at a paint damage (i.e., nick of the paint film applied on the substrate of sheet steel) mainly caused by the attack of stones or sands used together with deicing salt.

If the substrate is a bare cold rolled sheet steel, red rust bleed occurs to form scab corrosion. In order to improve cosmetic corrosion resistance on the exposed surface, therefore, it is expected that red rust bleed through a nick of the paint film can effectively be suppressed if a pre-coated sheet steel having a plating layer capable of sacrificial protection such as zinc plated sheet steel is employed as the substrate. However, such pre-coated sheet steels are disadvantageous in that the corrosion rate of zinc accompanying the sacrificial protection is so rapid that corrosion of the zinc layer itself tends to spread under the paint film to the surroundings of the nick, resulting in creepage of the paint film. Fe-Zn alloy plated sheet steels can reduce such corrosion under the paint film, but they tend to develop paint defects called "craters" in cathodic electrophoretic coating usually employed in painting of automobile exterior panels.

On the other hand, Zn-Ni alloy plated sheet steels do not show sacrificial protection sufficient to prevent red rust bleed through a nick of the paint film, although they provide good protection against the under-paint film corrosion.

If it is attempted that the red rust bleed through a nick of the paint film is prevented by increasing the coating weight of the plating layer, the superior formability and weldability of thin plated sheet steels will be lost.

In view of these problems of the prior art single layer plated sheet steels, duplex plated sheet steels have been developed which consists of two different Zn base plated layers on a base sheet steel.

Duplex plated sheet steels which have a lower Zn-Ni alloy layer and an upper Zn alloy or Zn composite layer are known in the art. For example, as indicated by the compositions of the lower layer/upper layer, Japanese Laid-Open Patent Application No. 207194/1982 discloses duplex plating of Zn-Ni/Zn-Fe (Fe=5–30%), Japanese Laid-Open Patent Application No. 145996/1982 discloses that of Zn-Ni/Zn-Fe-Ni or -Co (Fe≧15%, Ni or Co=0.5–8.5%) and Japanese Laid-Open Patent Application No. 70291/1982 discloses that of Zn-Ni/Zn-Cr (Cr=0.005–0.5%).

However, these prior art duplex platings are still unsatisfactory. For example, in the case of duplex plated sheet steels having an upper layer of Zn-Fe alloy, if the upper layer is an alloy of low Fe content, the corrosion rate of the duplex layer will become higher as discussed in the aforementioned Japanese Laid-Open Patent Application Nos. 207914/1982 and 145996/1982. Therefore, these Japanese applications teach that the upper layer should consists of a Zn-Fe alloy of relatively high Fe content. However, as the Fe content increases, the resulting alloy layer contains more Zn-Fe alloy phases. When an electrophoretic coating is applied on such plating, paint flaws called "craters" are often observed on the paint film after the electrophoretic coating and even after finish coating, deteriorating the film appearance significantly.

When the upper layer is a Zn-Cr alloy plating, the corrosion resistance of the duplex plating is improved with an increase in the Cr content of the alloy as described in Japanese Laid-Open Patent Application No. 70291/1982. However, Zn-Cr alloys containing more than 0.5% Cr render the plating appearance inferior so that the Cr content of the alloy is limited to 0.5% or less in this Japanese application. As a result, the improvement in corrosion resistance obtained by the use of a Zn-Cr alloy plating is also limited.

Japanese Laid-Open Patent Application No. 38494/1981 discloses a duplex plated sheet steel having a lower layer of Zn-Ni alloy (2–20% Ni) and an upper layer of Zn wherein the ratio of the film thickness of the lower layer to the total film thickness of the lower and upper layers is not greater than 1:5 (i.e., the ratio of the film thickness of the lower Zn-Ni alloy layer to that of the upper Zn layer is not greater than 1:4). The duplex plated sheet steel disclosed in this Japanese application is described as having good corrosion resistance, but the application does not teach anything about cosmetic corrosion resistance thereof. However, the cosmetic corrosion resistance of such duplex plated sheet steel is expected to be rather poor because the duplex plating disclosed has a thick Zn upper layer on a thin lower Zn-Ni alloy layer. The thin plating of Zn-Ni alloy as disclosed in the above Japanese application is not sufficient to improve the corrosion resistance. On the other hand, the upper Zn plating layer is effective for sacrificial protection of the base steel surface, but a thick layer of Zn will result in the creepage of paint film due to excessive dissolution of Zn under the paint film if the film is damaged to form nicks. Thus, a combination of a thin Zn-Ni alloy plating and a thick Zn plating is disadvantageous with respect to resistance to cosmetic corrosion at nicks of paint film.

SUMMARY OF THE INVENTION

It has now been found that duplex plating consisting of a thin Zn layer deposited on a lower Zn base alloy layer provides excellent protection against cosmetic corrosion as well as improved resistance to cratering in cathodic electrophoretic coating.

It has also been found that addition of a small amount of one or more specific metallic additives to the upper thin Zn layer in the above duplex plating is effective for controlling the rate of under-film Zn dissolution (corrosion) of the plating at nicks of overlaid paint film, providing further improvement in cosmetic corrosion resistance.

Thus, according to the present invention, there is provided a corrosion resistant duplex plated sheet steel, which comprises a sheet steel having on at least one surface thereof a lower layer of Zn base alloy plating and an upper layer thereon selected from a zinc plating having a coating weight of 0.1–5 g/m$^2$ and a zinc alloy or zinc composite plating having a coating weight of 0.1–10 g/m$^2$ wherein the ratio of the coating weight of the lower layer to that of the upper layer is at least 1:1, said zinc alloy or zinc composite plating for the upper layer comprising, on a weight basis as metal:

at least 80% Zn, and one or more additives as Zn corrosion inhibitors selected from:
- not greater than 7% Ni,
- not greater than 7% Co,
- not greater than 7% Mn,
- not greater than 7% Sn,
- not greater than 10% Ti,
- not greater than 10% Al,
- not greater than 10% Mg, and
- not greater than 10% Si.

The duplex plated sheet steel according to the present invention is particularly suitable for automobile exterior panels with a conventional paint film thereon such as a three coat-type paint film formed by cathodic electrophoretic coating, primer surfacer coating and top coating. When the duplex plating is used for this purpose, i.e., pre-coating of the exposed surface of automobile exterior panels, the opposite surface, i.e., unexposed side of the sheet steel may be pre-coated with highly corrosion resistant alloy such as Zn-Ni alloy or the like, which may further coated with an organic coating containing some pigments.

DESCRIPTION OF THE PREFERRED EMBODIMENTS

According to the present invention, the compositions of the lower and upper plating layers are defined as above for the following reasons. Throughout the specification all the percents are by weight unless otherwise specified.

The lower layer of the duplex plating of the present invention may be formed from any Zn base alloy having good bare corrosion resistance such as Zn-Ni (7–20% Ni), Zn-Fe (7–40% Fe), Zn-Ni-Fe (5–20% Ni, 5–30% Fe) and Zn-Co (5–20% Co). Preferably the Zn base alloy comprises at least 75% Zn. Layers of these zinc base alloys may be prepared by a conventional electroplating process. Alternatively, layers of Zn-Fe alloys may be prepared by a well-known galvannealing process wherein a cold rolled steel strip is subjected to hot-dip galvanizing and galvannealing consecutively.

There is a difference in coating structure of Zn-Fe alloys between the products prepared by these processes; an electroplated Zn-Fe alloy consists of a mixture of $\eta$ (eta), $\delta$ (delta), $\Gamma$ (gamma), and so on, while a galvannealed Zn-Fe alloy consists of layer by layer structure of $\delta$, $\zeta$ (zeta), and $\Gamma$ phases. They nevertheless show similar cosmetic corrosion behavior. They both provide a better protection against red rust bleed at nicks of paint film than Zn-Ni alloys, since they have greater sacrificial protectivity. However, as mentioned previously, both the electroplated and galvannealed Zn-Fe alloys, if present as a single layer or as an upper layer as proposed in the prior art, often cause cratering in cathodic electrophoretic coating, significantly deteriorating the film appearance after painting. On the contrary, pre-coated sheet steels of the present invention do not suffer this disadvantage because of the presence of an Fe-free upper layer.

A particularly suitable Zn base alloy for the lower layer is a Zn-Ni alloy containing 7–20% Ni, and preferably 10–15% Ni, since a Zn-Ni alloy of Ni content in this range has markedly improved corrosion resistance with respect to under-paint film corrosion. The term "Zn-Ni alloy" used herein includes not only an alloy consisting essentially of Zn and Ni but also an alloy which further contains in addition to Zn and Ni a minor amount of one or more alloying elements such as Co or Cr as disclosed in Japanese Patent Publication Nos. 33347/1982 and 6796/1983 and Japanese Laid-Open Patent Application No. 67188/1982. Similarly, other Zn alloys specified herein may further contain a minor amount of an additional alloying element such as Co or Cr.

In one embodiment of the duplex plated sheet steel of the invention, the upper layer is substantially pure Zn having a coating weight of 0.1–5 g/m$^2$, which may be prepared by a conventional electroplating procedure. The rate of dissolution or corrosion of Zn plating is rapid and tends to cause creepage of paint film at nicks. However, when the upper Zn layer is very thin and has a coating weight in the above range, the creepage of paint film can be avoided effectively.

In another embodiment, the upper layer is a Zn alloy or Zn composite plating containing one or more additives selected from Ni, Co, Mn, Sn, Ti, Al, Mg and Si. These additives serve to control the corrosion rate of Zn, or in other words serve as an inhibitor to Zn corrosion.

Specifically, each of Ni, Co, Mn and Sn is electrodeposited as a metal from a zinc electroplating bath and forms a solid solution or alloy with zinc, thereby controlling the rate of dissolution of Zn to a moderate degree. These metals exert their effects most significantly when their content is not greater than 7% and preferably not greater than 5% and at least 0.1%. If Ni, Co, Mn or Sn is present in an amount outside the above range, the resulting duplex plating may readily cause creepage of paint film or red rust bleed at nicks of paint film, and satisfactory cosmetic corrosion resistance can no longer be obtained.

Ti, Al, Mg and Si cannot be electrodeposited from their solutions, but they can be added to the electroplating bath in the form of oxides, hydroxides, or metallic powder so as to co-deposit in the zinc matrix. These additives serve to control the rate of Zn corrosion to a moderate degree by forming a protective layer on the surface of the Zn plating in cooperation with Zn corrosion products, thereby contributing to the improvement of the corrosion resistance of Zn plating. Ti, Al, Mg and Si can exert their effect on improvement in cosmetic corrosion resistance sufficiently when at least one of them is present in the Zn plating. The content of Ti, Al, Mg and Si in the upper layer plating should be each not greater than 10%, preferably not greater than 5%. If the content exceeds 10%, their effect as a Zn corrosion inhibitor becomes excessively high and it is difficult for the upper layer to exert its sacrificial protectivity to a desirable degree. In order to ensure that their effects as Zn corrorion inhibitors can be attained sufficiently, it is preferred that at least one of them be present in an amount of 0.1% or more in the upper layer.

In addition to one or more additives of Ni, Co, Mn, Sn, Ti, Al, Mg and Si, the upper zinc base layer may further contain one or more additives selected from Mo, W and Cr, whereby a good cosmetic corrosion resistance can also be obtained at the same level or at an improved level. It is thought that Mo and W are deposited in the Zn matrix in the form of oxides or hydroxides while Cr is electrodeposited as a metal to form a solid solution in the Zn matrix. As a result, these metals contribute to form a protective layer on the plating which reduces corrosion or dissolution of Zn. As disclosed in the aforementioned Japanese Laid-Open Patent Application No. 70291/1982, if only Cr is added to Zn, the resulting Zn-Cr plating will have a poor appearance. However, according to the present invention, Cr is deposited with at least one of Ni, Co, Mn, Sn, Ti, Al, Mg and Si in the Zn matirx. In such cases, deterioration in plating appearance due to incorporation of cr is largely reduced.

It has been found that addition of one or more of Mo, W and Cr to the plating bath without other Zn corrosion inhibiting additives is not sufficiently effective for control of rate of Zn corrosion. In contrast, addition of one or more of these metals in conjunction with one or more of Ni, Co, Mn, Sn, Ti, Al, Mg and Si produces an improvement in cosmetic corrosion resistance of the Zn plating. In the event where at least one of Mo, W and Cr is added, the amount of each of these additives added to Zn should be not greater than 7% and preferably not greater than 5%, because it has been found that their beneficial effect on cosmetic corrosion resistance is significantly high in amounts of 7% or less. Preferably, they are present in amounts of at least 0.1% in the Zn plating when they are added.

As discussed above, according to the present invention, the upper layer of the duplex plating employed in the present invention may be either Zn plating or a Zn alloy or composite plating. In the latter case, the additives which may be present in the upper layer can be selected from a wide variety of metal species. It is expected that the desired moderate control of the rate of Zn corrosion can be achieved in all the possible combinations of the metal species specified herein although the degree of control of Zn corrosion may vary depending on the metal species employed. When two or more of additives are added as Zn corrosion inhibitors to the upper layer, the total amount of these additives should not be too large in order to avoid excessive control of the rate of Zn corrosion, which may adversely affect the sacrificial protectivity of the plating at nicks of paint film. In this connection, the upper layer should comprise at least about 80% Zn, preferably at least about 90% Z, and it may consist essentially of Zn alone. Thus, the total amount of two or more alloying or compositing additives does not exceed about 20%, preferably about 10% of the upper layer. The optimum amount of the additives as Zn corrosion inhibitors which may be present in the upper layer can be determined experimentally by those skilled in the art. The content of additives referred to herein is expressed as a weight percent as metal.

The duplex plated sheet steel of the present invention may be prepared in accordance with conventional zinc plating procedures such as electroplating and hot-dip galvanizing. For example, a cold rolled steel strip may be degreased and pickled to make the surface clean and active, and then subjected to Zn base alloy plating such as Zn-Ni alloy plating to deposit the lower layer thereon. The Zn-Ni alloy plating may be carried out using a conventional Zn electroplating bath of the sulfate or chloride type in which a part (e.g., about 40–90%) of the zinc sulfate or chloride in the plating bath is replaced by nickel sulfate or chloride. Typical electroplating conditions are as follows: pH of about 1.0–3.0, bath temperature of about 50°–70° C., and current density of about 50–100 A/dm$^2$. The lower layer of Zn base alloy may be electrodeposited at a weight usually employed in the prior arts in the range of about 5–90 g/m$^2$. When the coating weight of the lower layer is too small, the excellent corrosion resistance inherent to Zn base alloy platings can no longer be retained. On the other hand, a thick plating of the lower layer exceeding 90 g/m$^2$ is generally unnecessary for practical purposes and unduly adds to the cost.

Other Zn alloy plating may be carried out in a similar manner. The plating conditions may also be the same as those employed in the conventional zinc electroplating.

Alternatively, as mentioned previously, a lower layer consisting of Fe-Zn alloy may be prepared by galvannealing, for example, in an actual Sendzimir type hot-dip galvanizing line; a cold rolled steel strip is hot-dip galvanized after passed through an oxidized and a reduced furnace and then annealed to form Fe-Zn alloy in the galvanized layer.

The resulting Zn-Ni, Zn-Fe or other Zn base alloy plated steel strip is then subjected to a second Zn base plating procedure to deposit on the lower layer an upper layer of Zn plating or Zn alloy or composite plating. When the upper layer is a zn alloy or composite plating, it comprises one or more Zn corrosion inhibiting additives selected from Ni, Co, Mn, Sn, Ti, Al, Mg and Si, and optionally at least one of Mo, W and Cr. The upper layer may also be deposited in accordance with conventional zinc electroplating procedures. When the upper layer is a Zn alloy or Zn composite plating, a part of the zinc compound (sulfate or chloride) in the plating bath is replaced by a compound or metallic powder of each metal additive selected. Specifically, these additives may be added to the Zn electroplating bath in the form of chlorides or sulfates for Ni, Co, Mn and Sn; molybdic, tungstic or chromic acid or a salt thereof for Mo, W and Cr; and oxides for Ti, Al, Mg and Si. These compounds may be added to the electroplating bath in such an amount that the desired content of each metal additive can be realized in the upper layer.

The coating weight of the upper layer should be in the range of about 0.1–5 g/m$^2$, preferably in the range of 0.5–4 g/m$^2$, and more preferably in the range of 1–3 g/m$^2$ when it is comprised of substantially pure zinc, and in the range of about 0.1–10 g/m$^2$, preferably in the range of 1–7 g/m$^2$, and more preferably in the range of 2–5 g/m$^2$ when the upper layer is a Zn alloy or composite plating which further contains as Zn corrosion inhibitor at least one of Ni, Co, Mn, Sn, Ti, Al, Mg and Si and optionally at least one of Mo, W and Cr. If the coating weight of the upper layer is less than about 0.1 g/m$^2$, it will be difficult to get a sufficient protection against cosmetic corrosion and therefore red rust bleed will occur at nicks of paint film. On the other hand, if the coating weight of the upper layer exceeds about 5 g/m$^2$ for pure Zn plating or about 10 g/m$^2$ for Zn alloy or composite plating, then the paint film may tend to show creepages or blisters, adversely affecting the corrosion resistance after painting. When the total amount of the Zn corrosion inhibiting additives in the upper Zn alloy or composite plating is extremely small such as not greater than 0.1%, the coating weight of the upper layer is preferably limited in the same range as defined above for the upper layer of pure Zn.

In accordance with the present invention, the ratio of the coating weight of the lower layer to that of the upper layer is at least 1:1, or in other words, the lower layer is at least as thick as the upper layer. If this ratio is less than 1:1, such as less than 1:4 as disclosed in the aforementioned Japanese Laid-Open Patent Application No. 38494/1981, the thickness of the lower layer is too small to obtain the desired improved corrosion resistance because the upper layer is a thin plating of 10 g/m$^2$ at greatest in order to avoid rapid under-film corrosion of the plating. Generally, the ratio of coating weight of the lower layer to that of the upper layer is at least 2:1.

The electroplating conditions for the upper layer may be the same as those employed in conventional zinc plating procedures as previously described in connection with the lower layer.

The following examples are given as specific illustrations of the present invention. It should be understood, however, that the specific details mentioned in the examples are merely illustrative and do not intend to limit the invention thereto.

EXAMPLE 1

This example illustrates duplex platings of sheet steel in which the lower layer is a Zn-Ni alloy optionally containing a minor amount of additional alloying element and the upper layer is pure Zn or Zn alloy or Zn composite plating.

Cold rolled sheet steels of 70 mm (w)×150 mm (l)×0.8 mm (t) were subjected to electrolytic degreasing and acid pickling by a conventional procedure and then electroplated in a beaker on one surface of each sheet with a Zn-Ni alloy to deposit Zn-Ni alloy platings of various nickel contents with various coating weights on the surfaces. The conditions for the first electroplating were as follows:

Plating bath composition:
zinc sulfate: 60–250 g/l
nickel sulfate: 260 g/l
Bath temperature: 50° C.
Bath pH: 1.5
Current density: 40 A/dm$^2$.

After the Zn-Ni alloy plated sheet steels were rinsed with water, they were subjected to a second electroplating using a basic plating bath containing 400 g/l of zinc sulfate to deposit upper layers of substantially pure Zn or a Zn alloy or Zn composite of various compositions on the lower layers. The conditions for the second electroplating were:

Bath temperature: 50° C.
Bath pH: 1.5
Current density: 40 A/dm$^2$.

When the upper layer is a zinc alloy or zinc composite plating, a compound of at least one metal selected from Ni, Co, Mn, Sn, Mo, W, Cr, Ti, Al, Mg and Si was added to the above basic electroplating bath containing 400 g/l of zinc sulfate. The specific compounds used in the preparation of the plating baths for the second electroplating were as follows: sulfates for Ni, Co, Mn and Sn; dichromic acid for Cr; ammonium molybdate for Mo; sodium tungstate for W; and oxides for Ti, Al, Mg and Si. More specifically the water insoluble oxides used were titanium dioxide (average particle diameter 0.1μ), alumina sol (average particle diameter 0.1μ), magnesium oxide (average particle diameter 0.1μ) and silica sol (average particle diameter 0.1μ), respectively.

All the resulting duplex plated sheet steel had a good appearance of gray or grayish white. The compositions and coating weights of the upper and lower layers of the duplex platings are summarized in Tables 2–7 below.

For comparison, comparative duplex plated sheet steels which did not fall within the range defined herein with respect to the composition or coating weight of either layer were prepared in the same manner as above. Also various prior art duplex or single layer zinc base plated sheet steels were prepared by conventional methods.

The duplex plated (i.e., pre-coated) sheet steels repared above were evaluated for cosmetic corrosion resistance and film coating appearance (cratering resistance) using the cyclic corrosion test, cratering test and accelerated atmospheric exposure test mentioned below. The cold rolled sheet steel used in this example as the base was also evaluated in the same way.

(1) Cyclic Corrosion Test (Cosmetic Corrosion Resistance):

Test pieces of the pre-coated sheet steels prepared in Example 1 were subjected to phosphating and three-coat painting according to processes commonly employed in coating of exposed surfaces of automobile bodies. Specifically, Steps (1)–(9) summarized in Table 1 below were conducted successively on the plated surfaces of the test pieces.

TABLE 1

| Step | Materials* and Conditions |
|---|---|
| (1) Degreasing | Lidorin SD 200 (spraying) |
| (2) Water rinsing | |
| (3) Surface conditioning | Fixodin 5TO (dipping) |
| (4) Phosphating | Glanodin SD 2000 (dipping) |
| (5) Water rinsing | |
| (6) Cathodic electrophoretic coating | Powercoat U-50 (150 V) film thickness 20μ |
| (7) Water rinsing | |
| (8) Primer surfacer coating | OTO 4811, film thickness 30μ |
| (9) Top coating | OTO 626, film thickness 35μ |

*The names of the materials used are all trade names of Nippon Paint Co., Ltd.

Each painted test piece was scribed with X lines on the coated surface to a depth reaching the base steel surface and then subjected to a cyclic corrosion test for 30 consecutinve days. The corrosion cycle used in this test consisted of the sequence of dipping in a salt solution (5% NaCl, 15 minutes at room temperature), drying (19 hours and 45 minutes at 50° C.) and wetting (90% relative humidity, 4 hours at 50° C.). The cosmetic corrosion resistance was evaluated by measuring the creepage width of the paint film from the scribed edge and determining the relative area of red rust at the scribe.

The creepage width of the coating film was measured on one side of the scribed X lines along the full length of each scribe line and the largest value was recorded as the measured value for creepage width.

The relative area of red rust was the percent of the area covered by red rust along the full length of the scribe lines.

(2) Cratering Test (Evaluation of Film Appearance):

Test pieces of each pre-coated sheet steel prepared in Example 1 were subjected to degreasing, surface conditioning and phosphating in the same manner as indicated in Table 1 above and then cathodically electropainted (i.e., by cathodic electrophoretic coating)

under the following conditions to evaluate the appearance of the paint film:

Conditions for cathodic electropainting:

Coating composition:

Powercoat U-50 (tradename of Nippon Paint Co., Ltd., 2 weeks aging after preparation of bath)

Temperature: 28°±1° C.

Applied voltage: 300 V

Coating time: 2 minutes

Film thickness: 20μ

Ratio of sample area/counter-electrode area:

½ (Sample area=0.8 $dm^2$)

Baking: 170° C.×20 minutes.

The evaluation was conducted by visually counting the craters of at least 0.1 mm in diameter found on the electropainted coating film and calculating the crater density expressed as the number of craters per $dm^2$. The following rating A, B or C was given based on the crater density:

Rating A: Less than 10 craters per $dm^2$;

Rating B: 10–1000 craters per $dm^2$;

Rating C: More than 1000 craters per $dm^2$.

(3) Accelerated Atmospheric Exposure Test (Cosmetic Corrosion Resistance):

Part of the pre-coated sheet steels prepared in the above-mentioned cyclic corrosion test (i.e., test pieces having a three-coat film formed by cathodic electropainting, primer surface coating and top coating on the pre-coated surface of the sheet steels prepared in Example 1) which had scribe lines on the coated surface to a depth reaching the base steel surface were subjected to an accelerated atmospheric exposure test for 2 years. In this test the corrosion of the test pieces was accelerated by spraying a 5% NaCl solution on each test piece twice a week. After 2 years, the creepage width of the paint film and the relative area of red rust were determined in the same manner as described in the cyclic corrosion test to evaluate the cosmetic corrosion resistance.

The results of these tests are also summarized in Tables 2–7 below.

Tables 2, 4, 5 and 7 show the results of cosmetic corrosion resistance in the cyclic corrosion test and crater density of cathodic electropainting film when the duplex plated sheet steels have an upper plating layer of pure zinc or a zinc alloy or composite containing at least one of Ni, Co, Mn and Sn (Table 2); a zinc alloy or composite containing at least one of Ni, Co, Mn and Sn plus at least one of Mo, W and Cr (Table 4); at least one of Ti, Al, Mg and Si (Table 5); or at least one of Ti, Al, Mg and Si plus at least one of the other additives listed above (Table 7). Tables 3 and 6 show the results of cosmetic corrosion resistance in the accelerated atmospheric exposure test of part of the duplex plated sheet steels shown in Tables 2 and 5, respectively. As can be seen from these tables, when either the coating weight of the upper layer or the content of the additive or additives therein was outside the range defined herein, the cosmetic corrosion resistance was generally inferior with respect to one or both of creepage width and red rust area. In contrast, the duplex plated sheet steels according to the present invention had improved cosmetic corrosion resistance in both the creepage width and red rust area.

The crater density found after cathodic electropainting on the duplex plating was given Rating A (less than 10 craters per $dm^2$) in each run of this invention. On the other hand, when the upper layer was an electroplating of Zn-Fe alloy, the crater density increased beyond 10 craters per $dm^2$ as shown in the conventional runs in Table 2.

EXAMPLE 2

This example illustrates duplex platings in which the lower layer is selected from various Zn base alloys and the upper layer is substantially pure zinc or a zinc alloy or zinc composite.

Cold rolled sheet steels of 70 mm (w)×150 mm (l)×0.8 mm (t) which were treated by electrolytic degreasing and acid pickling in a conventional manner were electroplated on one surface of each sheet with a Zn-Ni, Zn-Fe, Zn-Ni-Fe or Zn-Co alloy and then with Zn metal or Zn alloy or Zn composite at various coating weights in the same way as described in Example 1.

In this example, however, some of Zn-Fe alloys as the lower layer were prepared by galvannealing in a Sendzimir type hot-dip galvanizing line. Specifically, a cold rolled steel strip was hot-dip galvanized at 460° C. after passed through an oxidized and a reduced furnace and then annealed at 560° C. Test panels for painting were prepared by cutting down from the galvannealed strip.

For comparison, various single-layer or duplex plated sheet steels were also prepared which did not fall within the range defined herein in terms of composition or coating weight of either layer.

The resulting duplex plated sheet steels were then subjected to phosphating and cathodic electrophoretic coating under the same conditions as in Example 1.

The electropainted sheet steels thus obtained were evaluated for appearance of the paint film (crater density) and cosmetic corrosion resistance. p The crater density was determined in the same manner as described in Example 1.

The cosmetic corrosion resistance was determined on test pieces each having scribed X lines on the electropainted surface by repeating a corrosion cycle consisting of the sequence of dipping in a salt solution (5% NaCl, 15 minutes at room temperature), drying (2 hours at room temperature) and wetting (90% relative humidity, 21.75 hours at 50° C.). After the cyclic corrosion treatment was continued for 30 days, the corrosion of the test pieces was evaluated by (1) the presence or absence of red rust covering the scribe and the creepage width of the paint film from the scribed edge determined in the same manner as in Example 1, and (2) the presence or absence of blisters in areas other than the scribe.

The results are summarized in Table 8 together with the compositions and coating weights of each electroplated layer of the duplex plated sheet steels.

As can be seen from Table 8, all the duplex plated sheet steels according to the present invention having a Zn base upper layer showed satisfactory results both in cosmetic corrosion resistance and in crater density. However, even in the cases where duplex plating is applied, a Zn plating of greater than 5 $g/m^2$ or a Zn alloy or composite plating of greater than 10 $g/m^2$ as the upper layer deteriorated cosmetic corrosion resistance, while an extremely thin plating of the upper layer resulted in the formation of more craters during the electropainting thereon. The conventional single-layer platings gave inferior results in cosmetic corrosion resistance and particularly single layers of Zn-Fe alloys produced numerous draters in the cratering test.

Although the invention has been described with preferred embodiments, it is to be understood that variations and modifications may be resorted to as is apparent to those skilled in the art. Such variations and modifications are to be considered within the purview of the scope of the claims appended hereto.

TABLE 2

| No. | Plating System (Lower/Upper) | (Additives in upper layer: one or more of Ni, Co, Mn, Sn) Lower Layer: Coating Weight ($g/m^2$) | Lower Layer: Content of Additive (%) | Upper Layer: Additive | Upper Layer: Coating Weight ($g/m^2$) | Upper Layer: Content of Additive (%) | Cyclic Corrosion Test: Creepage Width (mm) | Cyclic Corrosion Test: Relative Area of Red Rust (%) | Crater Density |
|---|---|---|---|---|---|---|---|---|---|
| This Invention | | | | | | | | | |
| A1 | Zn—Ni/Zn | 18 | Ni:11 | — | 2 | — | 1 | 0 | A |
| A2 | Zn—Ni—Co/Zn | 17 | Ni:12 Co:0.5 | — | 3 | — | 0 | 0 | A |
| A3 | An—Ni—Cr/Zn | 18 | Ni:12 Cr:0.5 | — | 2 | — | 1 | 0 | A |
| A4 | " | 15 | Ni:12 Cr:0.5 | — | 5 | — | 2 | 0 | A |
| A5 | Zn—Ni/Zn—Ni | 19 | Ni:11 | Ni | 1 | 3 | 0 | 2 | A |
| A6 | " | 16 | " | " | 4 | " | 0 | 0 | A |
| A7 | " | 10 | " | " | 10 | " | 2 | 0 | A |
| A8 | " | 18 | Ni:12 | " | 2 | 0.1 | 2 | 0 | A |
| A9 | " | " | " | " | " | 2 | 0 | 0 | A |
| A10 | " | " | " | " | " | 5 | 0 | 0 | A |
| A11 | Zn—Ni—Co/Zn—Ni | " | Ni:12 Co:0.5 | " | " | " | 0 | 0 | A |
| A12 | " | " | Ni:10 Co:5 | " | " | " | 0 | 0 | A |
| A13 | Zn—Ni—Cr/Zn—Ni | " | Ni:12 Cr:0.2 | " | " | " | 0 | 0 | A |
| A14 | Zn—Ni/Zn—Co | " | Ni:13 | Co | " | 5 | 0 | 0 | A |
| A15 | Zn—Ni—Cr/Zn—Co | 12 | Ni:12 Cr:0.5 | " | 8 | " | 0 | 0 | A |
| A16 | Zn—Ni—Co/Zn—Co | " | Ni:12 Co:5 | " | " | " | 0 | 0 | A |
| A17 | Zn—Ni/Zn—Mn | 18 | Ni:12 | Mn | 2 | 6 | 0 | 2 | A |
| A18 | Zn—Ni/Zn—Sn | " | " | Sn | " | 2 | 2 | 1 | A |
| A19 | Zn—Ni/Zn—Ni—Co | " | " | Ni,Co | " | Ni:2 Co:1 | 0 | 0 | A |
| A20 | " | " | " | " | " | Ni:4 Co:2 | 0 | 2 | A |
| A21 | Zn—Ni/Zn—Ni—Sn | 18 | Ni:11 | Ni,Sn | 2 | Ni:2 Sn:0.5 | 0 | 0 | A |
| A22 | Zn—Ni—Co/Zn—Ni—Co | " | Ni:11 Co:0.2 | Ni,Co | " | Ni:2 Co:4 | 0 | 2 | A |
| Comparative | | | | | | | | | |
| B1 | Zn—Ni/Zn | 20 | Ni:11 | — | 0.05* | — | 3 | 30 | B |
| B2 | " | 10 | " | — | 10* | — | 8 | 10 | A |
| B3 | Zn—Ni—Cr/Zn | 5 | Ni:12 Cr:0.5 | — | 15* | — | 8 | 15 | A |
| B4 | Zn—Ni/Zn—Ni | 19.5 | Ni:11 | Ni | 0.05* | 3 | 3 | 35 | B |
| B5 | " | 5 | " | " | 15* | " | 10 | 0 | A |
| B6 | " | 18 | Ni:12 | " | 2 | 8* | 2 | 30 | A |
| B7 | Zn—Ni/Zn—Ni—Co | 15 | Ni:10 | Ni,Co | 5 | Ni:10* Co:5 | 5 | 40 | A |
| B8 | Zn—Ni/Zn—Co | 19.5 | Ni:12 | Co | 0.05* | 3 | 3 | 35 | B |
| B9 | " | 5 | " | " | 15* | " | 12 | 0 | A |
| B10 | " | 18 | Ni:5* | " | 2 | " | 15 | 30 | A |
| B11 | " | " | Ni:25* | " | " | " | 5 | 70 | A |
| Conventional | | | | | | | | | |
| C1 | Zn—Ni/Zn—Fe | 16 | Ni:13 | Fe | 4 | 20 | 2 | 20 | C |
| C2 | " | 18 | " | " | 2 | 10 | 5 | 15 | C |
| C3 | Zn—Ni | 20 | Ni:12 | — | — | — | 3 | 40 | B |
| C4 | Zn | " | — | — | — | — | 10 | 10 | A |
| C5 | Cold Rolled Sheet Steel | — | — | — | — | — | 5 | 100 | A |

(*Outside the range of this invention)

TABLE 3

| No. | Plating System (Lower/Upper) | (Additives in upper layer: one or more of Ni, Co, Mn, Sn) Lower Layer: Coating Weight ($g/m^2$) | Lower Layer: Content of Additive (%) | Upper Layer: Additive | Upper Layer: Coating Weight ($g/m^2$) | Upper Layer: Content of Additive (%) | Atmospheric Exposure Test: Creepage Width (mm) | Atmospheric Exposure Test: Relative Area of Red Rust (%) |
|---|---|---|---|---|---|---|---|---|
| This Invention | | | | | | | | |
| A5 | Zn—Ni/Zn—Ni | 19 | Ni:11 | Ni | 1 | 3 | 0 | 2 |
| A6 | " | 16 | " | " | 4 | " | 0 | 0 |

TABLE 3-continued

| No. | Plating System (Lower/Upper) | Lower Layer: Coating Weight ($g/m^2$) | Lower Layer: Content of Additive (%) | Upper Layer: Additive | Upper Layer: Coating Weight ($g/m^2$) | Upper Layer: Content of Additive (%) | Atmospheric Exposure Test: Creepage Width (mm) | Atmospheric Exposure Test: Relative Area of Red Rust (%) |
|---|---|---|---|---|---|---|---|---|
| | | (Additives in upper layer: one or more of Ni, Co, Mn, Sn) | | | | | | |
| A7 | " | 10 | " | " | 10 | " | 1 | 0 |
| A14 | Zn—Ni/Zn—Co | 18 | Ni:13 | Co | 2 | 5 | 0 | 0 |
| A17 | Zn—Ni/Zn—Mn | " | Ni:12 | Mn | " | 6 | 0 | 2 |
| A18 | Zn—Ni/Zn—Sn | " | " | Sn | " | 2 | 0 | 1 |
| A19 | Zn—Ni/Zn—Ni—Co | " | " | Ni,Co | " | Ni:2 Co:1 | 0 | 0 |
| A20 | " | " | " | " | " | Ni:4 Co:2 | 0 | 0 |
| A21 | Zn—Ni/Zn—Ni—Sn | " | Ni:11 | Ni,Sn | " | Ni:2 Sn:0.5 | 0 | 1 |
| A22 | Zn—Ni—Co/Zn—Ni—Co | " | Ni:11 Co:0.2 | Ni,Co | " | Ni:2 Co:4 | 0 | 1 |
| Comparative | | | | | | | | |
| B4 | Zn—Ni/Zn—Ni | 19.5 | Ni:11 | Ni | 0.05* | 3 | 5 | 45 |
| B5 | " | 5 | " | " | 15* | " | 8 | 5 |
| B6 | " | 18 | Ni:12 | " | 2 | 8* | 5 | 35 |
| B7 | Zn—Ni/Zn—Ni—Co | 15 | Ni:10 | Ni,Co | 5 | Ni:10* C.:5 | 8 | 25 |
| Conventional | | | | | | | | |
| C1 | Zn—Ni/Zn—Fe | 16 | Ni:13 | Fe | 4 | 20 | 5 | 40 |
| C2 | " | 18 | " | " | 2 | 10 | 5 | 30 |
| C3 | Zn—Ni | 20 | Ni:12 | — | — | — | 3 | 50 |
| C4 | Zn | " | — | — | — | — | 5 | 0 |
| C5 | Cold Rolled Sheet Steel | — | — | — | — | — | 10 | 100 |

(*Outside the range of this invention)

TABLE 4

| No. | Plating System (Lower/Upper) | Lower Layer: Coating Weight ($g/m^2$) | Lower Layer: Content of Additive (%) | Upper Layer: Additive | Upper Layer: Coating Weight ($g/m^2$) | Upper Layer: Content of Additive (%) | Cyclic Corrosion Test: Creepage Width (mm) | Cyclic Corrosion Test: Relative Area of Red Rust (%) | Crater Density |
|---|---|---|---|---|---|---|---|---|---|
| | | (Additives in upper layer: one or more of Ni, Co, Mn, Sn + one or more of Mo, W, Cr) | | | | | | | |
| This Invention | | | | | | | | | |
| D1 | Zn—Ni/Zn—Ni—Mo | 18 | Ni:11 | Ni,Mo | 2 | Ni:2 Mo:0.2 | 0 | 1 | A |
| D2 | Zn—Ni/Zn—Ni—W | " | " | Ni,W | " | Ni:2 W:0.2 | 0 | 1 | A |
| D3 | Zn—Ni—Cr/Zn—Ni—Cr | " | Ni:11 Cr:0.1 | Ni,Cr | " | Ni:4 Cr:1 | 0 | 2 | A |
| D4 | Zn—Ni/Zn—Co—Mo | 15 | Ni:13 | Co,Mo | 5 | Co:4 Mo:0.2 | 0 | 0 | A |
| D5 | Zn—Ni/Zn—Co—W | " | " | Co,W | " | Co:4 W:0.5 | 0 | 0 | A |
| D6 | Zn—Ni/Zn—Ni—Mo | " | " | Ni,Mo | " | Ni:5 Mo:3 | 0 | 1 | A |
| Comparative | | | | | | | | | |
| E1 | Zn—Ni/Zn—Co—Mo | 16 | Ni:12 | Co,Mo | 4 | Co:8* Mo:2 | 5 | 10 | A |
| E2 | " | " | " | " | " | Co:3 Mo:8* | " | " | A |

(*Outside the range of this invention)

TABLE 5

| No. | Plating System (Lower/Upper) | Lower Layer: Coating Weight ($g/m^2$) | Lower Layer: Content of Additive (%) | Upper Layer: Additive | Upper Layer: Coating Weight ($g/m^2$) | Upper Layer: Content of Additive (%) | Cyclic Corrosion Test: Creepage Width (mm) | Cyclic Corrosion Test: Relative Area of Red Rust (%) | Crater Density |
|---|---|---|---|---|---|---|---|---|---|
| | | (Additives in upper layer: one or more of Ti, Al, Mg, Si) | | | | | | | |
| This Invention | | | | | | | | | |
| F1 | Zn—Ni/Zn—Ti | 16 | Ni:12 | Ti | 4 | Ti:0.5 | 0 | 2 | A |
| F2 | " | " | " | " | " | Ti:5 | 0 | 1 | A |
| F3 | Zn—Ni/Zn—Al | 18 | " | Al | 2 | Al:2 | 2 | 2 | A |
| F4 | Zn—Ni/Zn—Mg | " | " | Mg | " | Mg:2 | 2 | 0 | A |
| F5 | Zn—Ni/Zn—Ti | " | " | Ti | " | Ti:0.5 | 1 | 1 | A |
| F6 | Zn—Ni/Zn—Si | " | " | Si | " | Si:5 | 0 | 2 | A |
| F7 | Zn—Ni—Cr/Zn—Al | " | Ni:12 Cr:0.2 | Al | " | Al:0.2 | 0 | 2 | A |
| F8 | Zn—Ni—Co/Zn—Si | " | Ni:12 | Si | " | Si:0.5 | 1 | 3 | A |

TABLE 5-continued

| No. | Plating System (Lower/Upper) | (Additives in upper layer: one or more of Ti, Al, Mg, Si) Lower Layer Coating Weight ($g/m^2$) | Lower Layer Content of Additive (%) | Upper Layer Additive | Upper Layer Coating Weight ($g/m^2$) | Upper Layer Content of Additive (%) | Cyclic Corrosion Test Creepage Width (mm) | Cyclic Corrosion Test Relative Area of Red Rust (%) | Crater Density |
|---|---|---|---|---|---|---|---|---|---|
| F9 | Zn—Ni/Zn—Ti—Si | " | Co:0.2 Ni:12 | Ti,Si | " | Ti:0.1 Si:5 | 0 | 1 | A |
| F10 | Zn—Ni/Zn—Al—Mg | " | " | Al,Mg | " | Al:0.2 Mg:0.1 | 2 | 0 | A |
| F11 | Zn—Ni/Zn—Si—Mg | 16 | " | Si,Mg | 4 | Si:0.05 Mg:2 | 3 | 2 | A |
| F12 | " | " | " | " | " | Si:0.5 Mg:0.05 | 3 | 3 | A |
| Comparative | | | | | | | | | |
| G1 | Zn—Ni/Zn—Ti | 16 | Ni:12 | Ti | 4 | Ti:15* | 10 | 30 | A |
| G2 | Zn—Ni/Zn—Ti | 19.5 | " | " | 0.05* | Ti:0.5 | 3 | 40 | A |
| G3 | " | 5 | " | " | 15* | " | 20 | 10 | A |

(*Outside the range of this invention)

TABLE 6

| No. | Plating System (Lower/Upper) | (Additives in upper layer: one or more of Ti, Al, Mg, Si) Lower Layer Coating Weight ($g/m^2$) | Lower Layer Content of Additive (%) | Upper Layer Additive | Upper Layer Coating Weight ($g/m^2$) | Upper Layer Content of Additive (%) | Atmospheric Exposure Test Creepage Width (mm) | Atmospheric Exposure Test Relative Area of Red Rust (%) |
|---|---|---|---|---|---|---|---|---|
| This Invention | | | | | | | | |
| F1 | Zn—Ni/Zn—Ti | 16 | Ni:12 | Ti | 4 | 0.5 | 1 | 0 |
| F2 | " | " | " | " | " | 5 | 1 | 2 |
| F3 | Zn—Ni/Zn—Al | 18 | " | Al | 2 | 2 | 0 | 0 |
| F4 | Zn—Ni/Zn—Mg | " | " | Mg | " | " | 0 | 0 |
| F5 | Zn—Ni/Zn—Ti | " | " | Ti | " | 0.5 | 0 | 0 |
| F6 | Zn—Ni/Zn—Si | " | " | Si | " | 5 | 0 | 2 |
| F9 | Zn—Ni/Zn—Ti—Si | " | " | Ti,Si | " | Ti:0.1 Si:5 | 0 | 2 |
| F10 | Zn—Ni/Zn—Al—Mg | " | " | Al,Mg | " | Al:0.2 Mg:0.1 | 2 | 0 |
| Comparative | | | | | | | | |
| G1 | Zn—Ni/Zn—Ti | 16 | Ni:12 | Ti | 4 | 15* | 5 | 15 |
| G2 | " | 19.5 | " | " | 0.05* | 0.5 | 2 | 40 |
| G3 | " | 5 | " | " | 15* | 0.5 | 10 | 5 |

(*Outside the range of this invention)

TABLE 7

| No. | Plating System (Lower/Upper) | (Additives in upper layer: one or more of Ti, Al, Mg, Si + one or more of other additive) Lower Layer Coating Weight ($g/m^2$) | Lower Layer Content of Additive (%) | Upper Layer Additive | Upper Layer Coating Weight ($g/m^2$) | Upper Layer Content of Additive (%) | Cyclic Corrosion Test Creepage Width (mm) | Cyclic Corrosion Test Relative Area of Red Rust (%) | Crater Density |
|---|---|---|---|---|---|---|---|---|---|
| This Invention | | | | | | | | | |
| H1 | Zn—Ni/Zn—Ni—Si | 16 | Ni:12 | Ni,Si | 4 | Ni:5 Si:0.5 | 0 | 0 | A |
| H2 | " | 12 | " | " | 8 | Ni:2 Si:10 | 0 | 2 | A |
| H3 | Zn—Ni/Zn—Co—Si | 18 | " | Co,Si | 2 | Co:6 Si:2 | 0 | 0 | A |
| H4 | " | 12 | " | " | 8 | Co:6 Si:8 | 0 | 2 | A |
| H5 | Zn—Ni/Zn—Co—Al | 16 | " | Co,Al | 4 | Co:5 Al:2 | 1 | 0 | A |
| H6 | Zn—Ni/Zn—Mn—Mg | " | " | Mn,Mg | " | Mn:5 Mg:2 | 0 | 0 | A |
| H7 | Zn—Ni/Zn—Co—Ti | " | " | Co,Ti | " | Co:5 Ti:0.5 | 0 | 0 | A |
| H8 | Zn—Ni—Cr/Zn—Ni—Si | " | Ni:12 Cr:0.2 | Ni,Si | " | Ni:5 Si:5 | 0 | 1 | A |
| H9 | Zn—Ni—Co/Zn—Co—Si | " | Ni:10 Co:5 | Co,Si | " | Co:4 Si:5 | 0 | 0 | A |
| H10 | Zn—Ni/Zn—Ni—Co—Si | " | Ni:12 | Ni,Co,Si | " | Ni:2,Co:3 Si:2 | 2 | 0 | A |
| H11 | Zn—Ni/Zn—Ni—Al—Si | " | " | Ni,Al,Si | " | Ni:2,Co:4, Al:0.2 | 0 | 0 | A |
| H12 | Zn—Ni/Zn—Co—Ti—Mo | " | " | Co,Ti,Mo | " | Co:4,Ti:2, Mo:0.2 | 0 | 0 | A |

TABLE 7-continued (Additives in upper layer: one or more of Ti, Al, Mg, Si + one or more of other additive)

| No. | Plating System (Lower/Upper) | Lower Layer: Coating Weight ($g/m^2$) | Lower Layer: Content of Additive (%) | Upper Layer: Additive | Upper Layer: Coating Weight ($g/m^2$) | Upper Layer: Content of Additive (%) | Cyclic Corrosion Test: Creepage Width (mm) | Cyclic Corrosion Test: Relative Area of Red Rust (%) | Crater Density |
|---|---|---|---|---|---|---|---|---|---|
| Comparative | | | | | | | | | |
| I1 | Zn—Ni/Zn—Ni—Si | 16 | Ni:12 | Ni,Si | " | Ni:10* Si:0.05 | 5 | 30 | A |
| I2 | " | " | " | " | " | Ni:0.05 Si:15* | 10 | " | A |
| I3 | " | " | " | " | " | Ni:10* Si:20* | " | " | A |
| I4 | Zn—Ni/Zn—Ni—Co—Si | " | " | Ni,Co,Si | " | Ni:10*,Co:15* Si:0.05 | 5 | 50 | A |
| I5 | " | " | " | " | " | Ni:5,Co:8*, Si:15* | " | 30 | A |

(*Outside the range of this invention)

TABLE 8

| No. | Lower Layer: Composition | Lower Layer: Coating Weight ($g/m^2$) | Upper Layer: Composition | Upper Layer: Coating Weight ($g/m^2$) | Crater Density | Cosmetic Corrosion Resistance** |
|---|---|---|---|---|---|---|
| This Invention | | | | | | |
| J1 | Zn—Ni(7%)—Co(0.5%) | 20 | Zn | 3 | A | O |
| J2 | Zn—Ni(10%)—Fe(5%) | " | " | 2 | " | " |
| J3 | Zn—Co(2%)—Cr(0.3%) | " | " | 1 | " | " |
| J4 | Zn—Fe(16%) | " | " | 2 | " | " |
| J5 | Zn—Fe(21%) | " | " | 2 | " | " |
| J6 | Zn—Fe(10%)+ | 45 | " | 4 | " | " |
| J7 | Zn—Fe(10%)+ | 60 | " | " | " | " |
| J8 | Zn—Ni(7%)—Co(0.5%) | 16 | Zn—Ni(3%) | " | " | " |
| J9 | " | 12 | Zn—Ni(2%)—Sn(0.5%) | 8 | " | " |
| J10 | " | 16 | Zn—Co(2%)—Mo(0.2%) | 4 | " | " |
| J11 | Zn—Ni(10%)—Fe(5%) | 18 | Zn—Co(5%) | 2 | " | " |
| J12 | " | 16 | Zn—Mn(5%) | 4 | " | " |
| J13 | " | " | Zn—Si(0.5%) | " | " | " |
| J14 | " | " | Zn—Co(5%)—Si(2%) | " | " | " |
| J15 | " | " | Zn—Co(4%)—Al(0.5%) | " | " | " |
| J16 | Zn—Co(2%)—Cr(0.3%) | 17 | Zn—Ni(2%)—Si(0.5%) | 3 | " | " |
| J17 | Zn—Fe(16%) | 16 | Zn—Ni(5%) | 4 | " | " |
| J18 | " | " | Zn—Ni(7%)—Co(5%) | " | " | " |
| J19 | " | " | Zn—Ni(7%)—W(0.8%) | " | " | " |
| J20 | " | " | Zn—Co(4%)—Cr(1%) | " | " | " |
| J21 | " | " | Zn—Ni(4%)—Ti(0.1%) | " | " | " |
| J22 | Zn—Fe(21%) | " | Zn—Co(2%)—Al(0.2%) | " | " | " |
| J23 | " | " | Zn—Mn(2%)—Mg(0.1%) | " | " | " |
| Comparative | | | | | | |
| K1 | Zn—Ni(7%)—Co(0.5%) | 10 | Zn | 10* | A | Δ |
| K2 | Zn—Ni(10%)—Fe(5%) | 20 | " | 0.05* | B | X |
| K3 | " | 10 | " | 10* | A | Δ |
| K4 | Zn—Ni(7%)—Co(0.5%) | 20 | Zn—Ni(3%) | 0.05* | B | X |
| K5 | " | 5 | " | 15* | " | Δ |
| K6 | Zn—Ni(10%)—Fe(5%) | 15 | Zn—Co(10%*)—Si(2%) | 5 | " | X |
| K7 | " | " | Zn—Co(2%)—Si(15%*) | " | " | X |
| K8 | " | 5 | Zn—Si(0.5%) | 15* | " | Δ |
| K9 | Zn—Fe(16%) | 20 | Zn—Ni(5%) | 0.05* | " | X |
| K10 | " | 16 | Zn—Ni(7%)—W(8%*) | 4 | " | X |
| K11 | " | 20 | Zn—Co(2%)—Al(0.2%) | 0.05* | " | Δ |
| Conventional | | | | | | |
| L1 | Zn—Ni(12%) | " | — | — | A | X |
| L2 | Zn—Ni(7%)—Co(0.5%) | " | — | — | " | " |
| L3 | Zn—Ni(10%)—Fe(5%) | " | — | — | " | " |
| L4 | Zn—Co(2%)—Cr(0.3%) | " | — | — | " | " |
| L5 | Zn—Fe(16%) | " | — | — | C | " |
| L6 | Zn—Fe(21%) | " | — | — | " | " |
| L7 | Zn—Fe(10%)+ | 45 | — | — | " | " |
| L8 | Zn—Fe(10%)+ | 60 | — | — | " | " |
| L9 | Zn—Ni(12%) | 20 | Fe | 3 | A | " |
| L10 | " | " | " | 5 | " | " |
| L11 | " | " | Zn—Fe(15%) | " | " | " |

TABLE 8-continued

| | Lower Layer | | Upper Layer | | | |
|---|---|---|---|---|---|---|
| No. | Composition | Coating Weight ($g/m^2$) | Composition | Coating Weight ($g/m^2$) | Crater Density | Cosmetic Corrosion Resistance** |
| L12 | Zn | " | — | — | " | Δ |

Note:
*Outside the range of this invention.
**Cosmetic corrosion resistance at scribe.
O: no red rust bleed and creepage width less than 2 mm.
Δ: no red rust bleed and creepage width of 2 mm or greater.
X: red rust bleed and creepage width of less than 2 mm.
+Prepared by a galvanneal process.

What is claimed is:

1. A corrosion resistant duplex plated sheet steel, which comprises a sheet steel having on at least one surface thereof a lower layer of Zn base alloy plating and an upper layer thereon of a zinc plating having a coating weight of 0.1–5 $g/m^2$ or a zinc alloy or zinc composite plating having a coating weight of 0.1 to 10 $g/m^2$ wherein the ratio of the coating weight of the lower layer to that of the upper layer is at least 1.5:1, said zinc alloy or zinc composite plating for the upper layer comprising, on a weight basis as metal:

at least 80% Zn, and one or more additives as Zn corrosion inhibitors selected from the group consisting of:

not greater than 7% Ni,
not greater than 7% Co,
not greater than 7% Mn,
not greater than 7% Sn,
not greater than 10% Ti,
not greater than 10% Al,
not greater than 10% Mg, and
not greater than 10% Si.

wherein the duplex plated sheet steel when covered by conventional paint films displays resistance to both cosmetic corrosion comprising paint creepage and red rust corrosion, and crater formation.

2. The corrosion resistant duplex plated sheet steel as defined in claim 1 wherein the upper layer is a zinc plating having a coating weight of 0.1–5 $g/m^2$.

3. The corrosion resistant duplex plated sheet steel as defined in claim 1 wherein the upper layer is a zinc alloy or zinc composite plating having a coating weight of 0.1–10 $g/m^2$ which comprises, on a weight basis as metal:

at least 80% Zn, and one or more additives as Zn corrosion inhibitors selected from:

not greater than 7% Ni,
not greater than 7% Co,
not greater than 7% Mn,
not greater than 7% Sn,
not greater than 10% Ti,
not greater than 10% Al,
not greater than 10% Mg, and
not greater than 10% Si.

4. The corrosion resistant duplex plated sheet steel as defined in claim 3 wherein the zinc alloy or zinc composite plating for the upper layer further comprises one or more additives as additional Zn inhibitors selected from:

not greater than 7% Mo,
not greater than 7% W, and
not greater than 7% Cr.

5. The corrosion resistant duplex plated sheet steel as defined in claim 1, further comprising a paint film on the upper layer.

6. A corrosion resistant duplex plated sheet steel, which comprises a sheet steel having on at least one surface thereof a lower layer of Zn base alloy plating and an upper layer thereon of Zn plating having a coating weight of 0.1–5 $g/m^2$, wherein the ratio of the coating weight of the lower layer to that of the upper layer is at least 1.5:1, and wherein the duplex plated sheet steel when covered by conventional paint films displays resistance to both cosmetic corrosion, comprising paint creepage and red rust corrosion, and crater formation.

7. The corrosion resistant duplex plated sheet steel as defined in claim 6 wherein the lower layer is comprised of Zn-Ni, Zn-Fe, Zn-Co or Zn-Ni-Fe alloy containing at least 75% by weight of Zn.

8. The corrosion resistant duplex plated sheet steel as defined in claim 6 wherein the lower layer is comprised of Zn-Ni alloy containing 7–20% by weight of Ni.

9. The corrosion resistant duplex plated sheet steel as defined in claim 6 wherein the lower layer is deposited at a coating weight of 5–90 $g/m^2$.

10. The corrosion resistant duplex plated sheet steel as defined in claim 6 wherein the upper zinc layer is deposited at a coating weight of 0.5–4 $g/m^2$.

11. The corrosion resistant duplex plated sheet steel as defined in claim 10 wherein the upper zinc layer is deposited at a coating weight of 1–3 $g/m^2$.

12. The corrosion resistant duplex plated sheet steel as defined in claim 6, further comprising a paint film on the upper layer.

13. A corrosion resistant duplex plated sheet steel, which comprises a sheet steel having on at least one surface thereof a lower layer of Zn base alloy plating and an upper layer thereon of zinc alloy or zinc composite plating having a coating weight of 0.1–10 $g/m^2$ wherein the ratio of the coating weight of the lower layer to that of the upper layer is at least 1.5:1, said zinc alloy or zinc composite plating for the upper layer comprising, on a weight basis as metal:

at least 80%, Zn, and one or more additives as Zn corrosion inhibitors selected from the group consisting of:

not greater than 7% Ni,
not greater than 7% Co,
not greater than 7% Mn,
not greater than 7% Sn,
not greater than 10% Ti,
not greater than 10% Al,
not greater than 10% Mg, and
not greater than 10% Si wherein the duplex plated sheet steel when covered by conventional paint films displays resistance to both cosmetic corrosion comprising paint creepage and red rust corrosion and crater formation.

14. The corrosion resistant duplex plated sheet steel as defined in claim 13 wherein the zinc alloy or zinc composite of the upper layer further comprises one or more additives as additional Zn inhibitors selected from:

not greater than 7% Mo,
not greater than 7% W, and
not greater than 7% Cr.

15. The corrosion resistant duplex plated sheet steel as defined in claim 13 wherein the additives present in the upper layer as Zn corrosion inhibitors are one or more selected from:

0.1–5% Ni,
0.1–5% Mn,
0.1–5% Ti,
0.1–5% Mg, and
0.1–5% Co,
0.1–5% Sn,
0.1–5% Al,
0.1–5% Si.

16. The corrosion resistant duplex plated sheet steel as defined in claim 14 wherein the additives present in the upper layer as additional Zn corrosion inhibitors are one or more selected from:

0.1–5% Mo, 0.1–5% Wo, and 0.1–5% Cr.

17. The corrosion resistant duplex plated sheet steel as defined in claim 13 wherein the lower layer is comprised of Zn-Ni, Zn-Fe, Zn-Co or Zn-Ni-Fe alloy containing at least 75% by weight of Zn.

18. The corrosion resistant duplex plated sheet steel as defined in claim 13 wherein the lower layer is comprised of Zn-Ni alloy containing 7–20% by weight of Ni.

19. The corrosion resistant duplex plated sheet steel as defined in claim 18 wherein the lower layer is comprised of Zn-Ni alloy containing 10–15% by weight of Ni.

20. The corrosion resistant duplex plated sheet steel as defined in claim 13 wherein the lower layer is deposited at a coating weight of 5–90 $g/m^2$.

21. The corrosion resistant duplex plated sheet steel as defined in claim 13 wherein the upper layer is deposited at a coating weight of 1–7 $g/m^2$.

22. The corrosion resistant duplex plated sheet steel as defined in claim 13, further comprising a paint film on the upper layer.

* * * * *